United States Patent [19]

Good et al.

[11] 3,999,477

[45] Dec. 28, 1976

[54] PRESS BLOCKING AND CONTROL SYSTEM

[75] Inventors: Maurice James Good, Oscoda; Benjamin W. Colman, Huntington Woods, both of Mich.

[73] Assignee: Starboard Industries, Inc., Birmingham, Mich.

[22] Filed: Sept. 19, 1975

[21] Appl. No.: 614,749

[52] U.S. Cl. ..... 100/53; 72/26; 100/99; 100/269 R; 100/292; 192/131 R; 425/153

[51] Int. Cl.[2] ..... B30B 15/00

[58] Field of Search ..... 100/53, 99, 292, 269 R, 100/229 R; 192/129 R, 131 R; 83/DIG. 1, 397, 544; 425/151, 152, 153; 72/25, 26

[56] References Cited

UNITED STATES PATENTS

| | | | |
|---|---|---|---|
| 2,240,630 | 5/1941 | Stacy | 100/53 |
| 2,946,277 | 7/1960 | Archer | 100/53 |
| 2,962,633 | 11/1960 | Raymond | 100/53 X |
| 2,990,578 | 7/1961 | Adair | 100/53 X |
| 3,359,598 | 12/1967 | Bucy | 100/53 X |
| 3,446,106 | 5/1969 | Ferris et al. | 100/229 R |
| 3,446,985 | 5/1969 | Carlisle et al. | 192/131 R |
| 3,452,618 | 7/1969 | Nagele | 100/53 X |
| 3,541,950 | 11/1970 | Anderson | 100/53 |
| 3,554,067 | 1/1971 | Scutella | 100/53 X |
| 3,628,357 | 12/1971 | Luenser | 100/53 X |
| 3,650,650 | 3/1972 | Cook | 425/153 |
| 3,749,005 | 7/1973 | Einecker et al. | 100/53 |
| 3,815,456 | 6/1974 | Braathen | 100/53 X |
| 3,832,875 | 9/1974 | Newman | 100/53 X |
| 3,884,336 | 5/1975 | Williamson | 192/131 R |

FOREIGN PATENTS OR APPLICATIONS

| | | | |
|---|---|---|---|
| 1,232,693 | 10/1960 | France | 100/53 |
| 6,905,597 | 10/1970 | Netherlands | 100/53 |

*Primary Examiner*—Billy J. Wilhite

[57] ABSTRACT

The press blocking and control system of this invention embodies a press ram blocking apparatus and circuitry and control means for moving a ram blocking member into ram stopping position thereunder upon the occurrence of one or more events justifying blocking of the pressed ram, to prevent injury or damage to personnel and equipment which would expectedly result from inadvertence, error or accident. The control circuitry for the blocking device is connected to and in association with conventional press control circuitry for the press ram actuating mechanism. For normal press operation, the ram blocking member is retained in retracted position by its actuating apparatus and control circuitry.

38 Claims, 15 Drawing Figures

PRESS BLOCKING AND CONTROL SYSTEM

SUMMARY OF THE INVENTION

The invention pertains to a press blocking and control system embodying a blocking device for insertion between the press ram and the die bed responsive to inadvertence, error or accident in press operation, to prevent movement of the press ram into substantial contact with the lower die or bolster plate whereby an injury may be caused to press operating personnel or damage to tooling in the press ram and die bed. The press ram blocking member is actuated for forward and retracted movement by a fluid cylinder controlled by a four-way valve admitting fluid to and discharging fluid from the cylinder. The valve is controlled for operation by a solenoid actuating the valve mechanism for admitting or withdrawing compressed air to or from the air cylinder. Alternatively, the blocking member can be connected or affixed to the solenoid pin actuated by the energized solenoid coil, for ram blocking movement.

The mechanical apparatus including the press ram blocking device, the air cylinder and control valve or the solenoid device are suitably mounted on the press for movement of the blocking device into ram blocking disposition upon the lower die plate. Conventional means for supporting the mechanical apparatus and components are utilized for mounting the same upon the press.

The control circuitry is connected to the same power source as is used for the press control panel circuitry, 115 vac. The control circuitry of the inventive system embodies means responsive to press operation whereby incorrect or inadvertent operation of press control devices results in actuation of the blocking member into press ram blocking disposition.

GENERAL DESCRIPTION

The press blocking and control system of this invention embodies several features for personnel and machine safety, and for increased production. The press ram blocking appartus embodies a movable adjustable blocking member, preferably of steel, that is removably insertable between the upper movable press ram and the lower bolster or die plate. As an example of its operation, in a press having a 3 inch stroke, operating at a speed of two strokes per second, should a malfunction occur, the blocking device will be disposed under the press ram in less than 1 inch of such stroke. Under these conditions, by virtue of the blocking device, at least 2 inches remain open under the press ram to provide ample safe space for the press operator's hands.

In another aspect, the inventive system shuts the electrical power off to the machine after the control system senses a double or continuous action malfunction, combining normal braking action in the press with disposition of the blocking member under the press ram. In addition, press and machine tool damage are reduced or substantially eliminated when the system of the invention is activated, by removing clutch power so that the press ram drops onto the stop block with little or no force.

In the exemplary embodiment of the invention described herein, the press operator must maintain full hand pressure of both hands on the press operating palm run buttons until the press stroke has gone through at least 180° of its single stroke cycle, thus reducing the possibility of the press ram "bottoming out". The control system's circuitry is connected in and to the press circuitry of which the palm buttons form a part.

In the event that the press is arranged for continuous operation, or inching operation as for tool setup, the inventive system can be de-activated, at which time a visual warning signal is illuminated. In addition, the inventive system embodies its own "test safe" circuitry, indicating the system's reliability for malfunction of the press, set-up or maintenance. Further, the circuitry has its own separate fused power supply, independent of the press motor starting relay, so that the press ram blocking system operates independently of the press drive. Other visual signals are embodied in the control system to assure and insure that control devices, such as limit switches, are functioning properly.

The important advantage of the press ram blocking and control system of this invention is in prevention of injury and damage to press operating personnel and equipment.

DRAWINGS

Various further and more specific objects, features and advantages of the invention will appear below, taken in connection with the accompanying drawings, illustrating an exemplary embodiment of the invention. Reference is here made to the drawings annexed hereto and forming an integral part of this specification, in which FIG. 1 is a side elevational view of a press embodying, in an exemplary form, mechanical apparatus and components of the invention.

DETAILED DESCRIPTION

Figure 1:
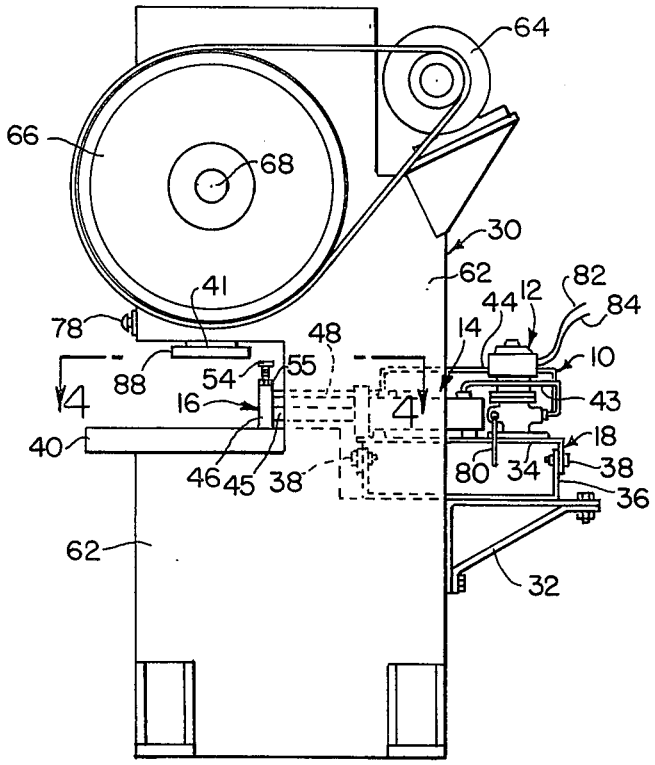
Figure 2:
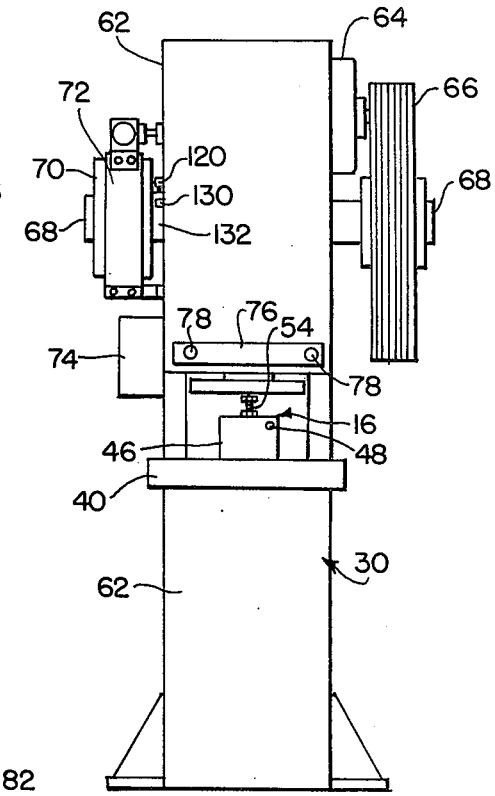
FIG. 2 is a front elevational view of the press and mechanical components illustrated in FIG. 1.
Figure 3:
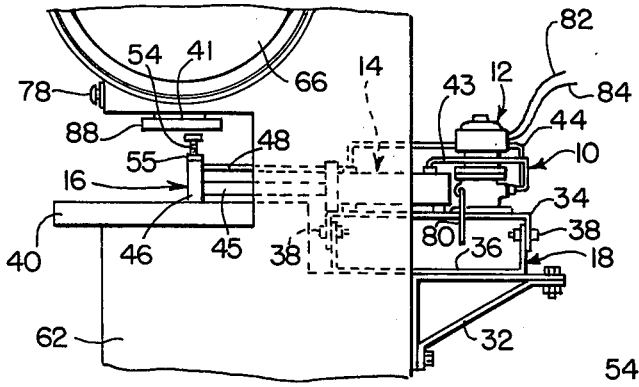
FIG. 3 is a fragmentary side elevational view corresponding substantially to the same portion illustrated in FIG. 1, here illustrating disposition of the blocking device in press ram bolster plate stopping position.

The exemplary embodiment of the invention described herein and illustrated in the FIGS. 1–4 of the drawings comprises a press ram blocking apparatus 10 in conjunction with control circuitry 20. The apparatus 10 comprises an air operated valve 12 served by a source of compressed air not shown, an air cylinder 14, a press ram blocking device 16 adjustable as to height and connected to the piston rod of the air cylinder, and an apparatus support device 18 upon and to which the valve and the air cylinder components are secured. The apparatus 10 is mounted upon the press, for actuation of the ram blocking component into and out of press ram stopping position, between the lower bolster or die plate and the upper movable ram. The control circuit 20 and its complementary circuits 20A and 20B are connected to a source of electrical power at the power control panel serving the press drive mechanism. The circuitry 20 includes a circuit board 22.

The apparatus 10 and circuitry 20 are mounted upon a press 30 having a bracket support 32 for the device 18 whereby the apparatus 10 is disposed on the press at an elevation and in a location permitting the press ram blockng device 16 to function in ram stopping disposition upon its forward actuation by the air cylinder piston rod. The location and securement of the apparatus 10 may vary from press to press. The support members 18 comprise a pair of upper and lower channel-type plates 34, 36 arranged in opposing relationship and secured at their vertical legs by suitable fasteners 38, whereby the apparatus 10 can be elevated into and supported in alignment with the upper surface of the lower die or bolster plate 40 of the press.

Fixedly mounted and secured upon and to the upper support member 34 are the valve 12 and the air cylinder 14. The valve 12 embodies an electrically actuated solenoid and is furnished with a supply of compressed air from a source not shown. Such source normally and conventionally furnishes the air supply for the press air clutch operation, but there can also be an independent source of compressed air, serving only the blocking and control system 10 of this invention. The valve 12 is connected by conduits 43, 44 with the chamber of the air cylinder 14 for operative movement of its piston and piston rod 45, the distal end of which is fixedly secured to the press ram blocking member 46.

Figure 4:
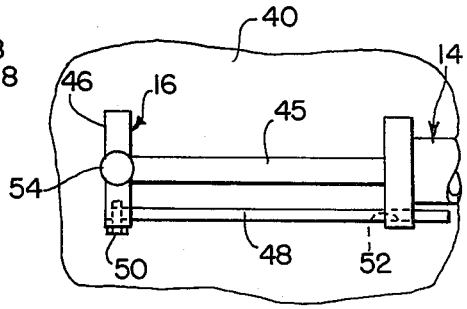
FIG. 4 is a fragmentary top plan view of the press ram blocking device and a portion of its associated actuating air cylinder, as illustrated in FIG. 1.

As illustrated more particularly in the enlarged view of FIG. 4, the blocking member 46 is guided for upright, non-rotating movement by the slide guide rod 48 preferably affixed at its forward end by a pin 50 to the blocking member 46 and slidable in a bearing 52 arranged as a part of or attached to one end of the air cylinder 14. The blocking device 46 is made adjustable as to height by means of the heavy screw 54 which is threadably mounted in the upper portion of the blocking member 46. A lock nut 55 threaded on the screw is adapted to lock the screw to the member 46 in its adjusted position.

The press 30 comprises in part a frame 62, a motor drive 64 belt-connected to a flywheel 66 mounted for rotation upon one end of a shaft 68 extending transversely through the frame and having a drum 70 mounted on its other end adapted for engagement by an air cylinder operated brake device 72 supported upon the frame 62. The shaft 68 also mounts a cam 132 which serves to actuate limit switches forming a part of the circuitry 20. A crank mounted substantially central on the shaft 68 is connected to and drives the press ram 41 in vertical reciprocating movement.

Electrical controls for operation of the press, in part are embodied on a panel board or in a panel box 74 which contains circuit means for the operator control panel 76 mounted upon the front of the press for easy operator access. The panel 76 is arranged with a pair of palm buttons 78, 78. The circuitry with which the buttons and their switches are connected requires that both palm buttons 78, 78 must be depressed substantially simultaneously to close the circuit to the press drive, and maintained in depressed position until at least 180° of the ram stroke has been effected. Thereafter, the palm buttons can be released and the stroke completed without actuation of the ram blocking apparatus 10.

The solenoid operated valve 12, of conventional construction, is supplied with compressed air by conduit 80 communicating with a suitable air source. A pair of conductors 82, 84 in the circuitry 20 are connected to the solenoid 86 operating the valve mechanism of the valve 12.

The press ram, driven by the flywheel 66 and shaft 68, is provided with an upper bolster plate 88 adapted to support tooling complementary to and cooperating with a die set mounted in the lower bolster plate 40, according to conventional practice.

Figure 11:
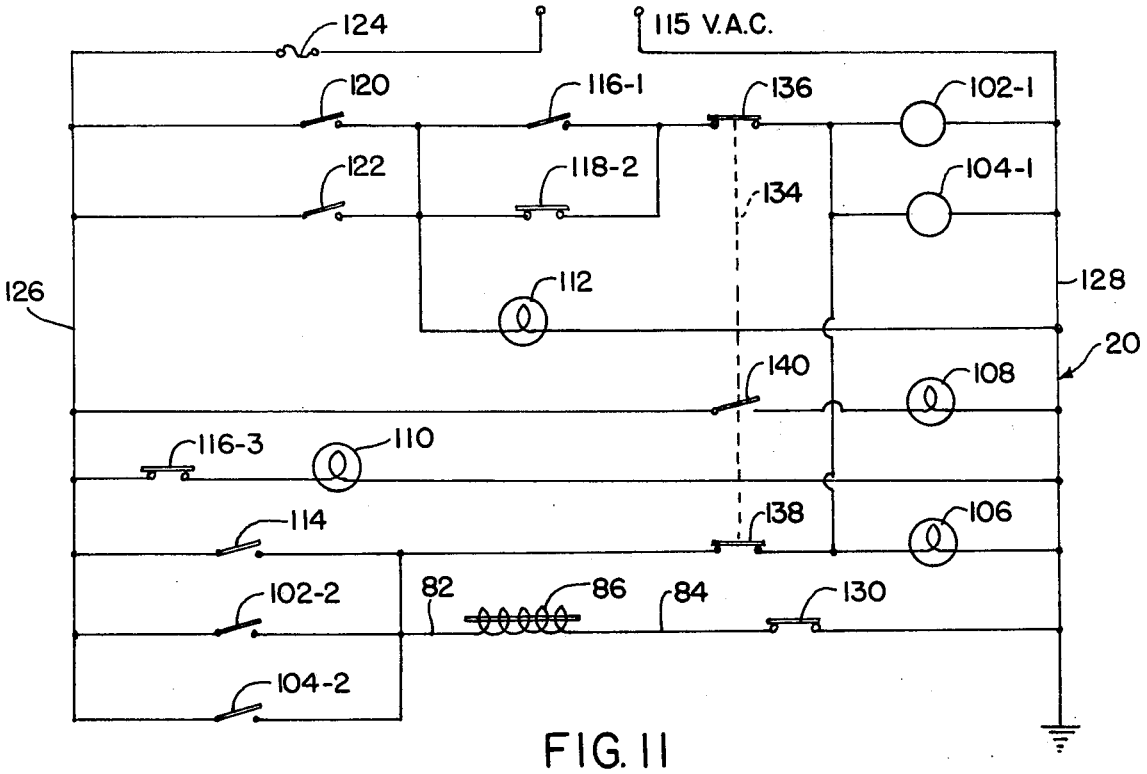
FIG. 11 is a diagrammatic view of an elemplary control circuitry for the system of the invention described and illustrated herein.
Figure 12:
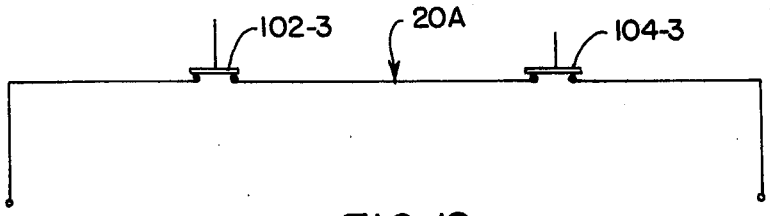
FIG. 12 is a diagrammatic view of certain features of circuitry utilized in conjunction with the control circuitry illustrated in FIG. 11 and conventional press control circuitry.
Figure 13:
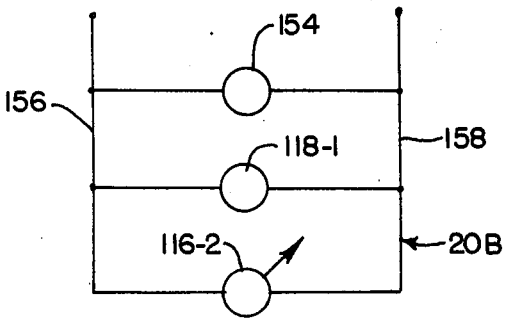
FIG. 13 is a diagrammatic view of certain additional features of circuitry illustrated in FIG. 11 and with the press control panel circuitry.
Figure 15:
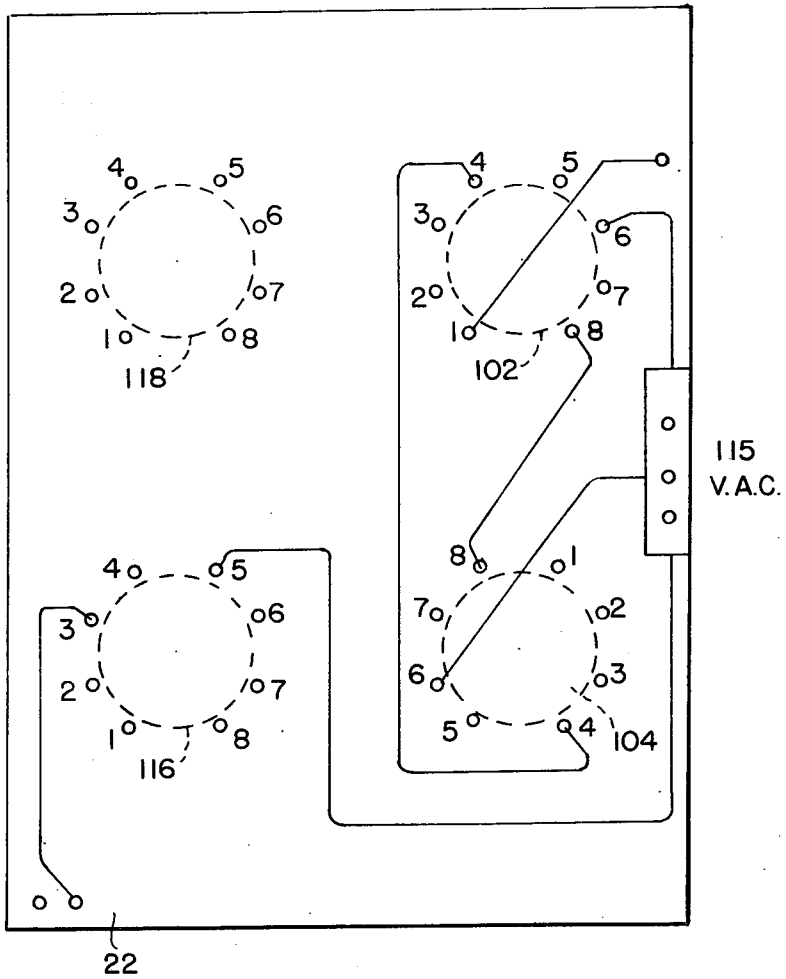
FIGS. 14 and 15 are top and bottom plan views respectively of a printed circuitry board utilized with relays and a timer forming control features of the circuitry illustrated in FIGS. 11, 12 and 13.
Figure 14:
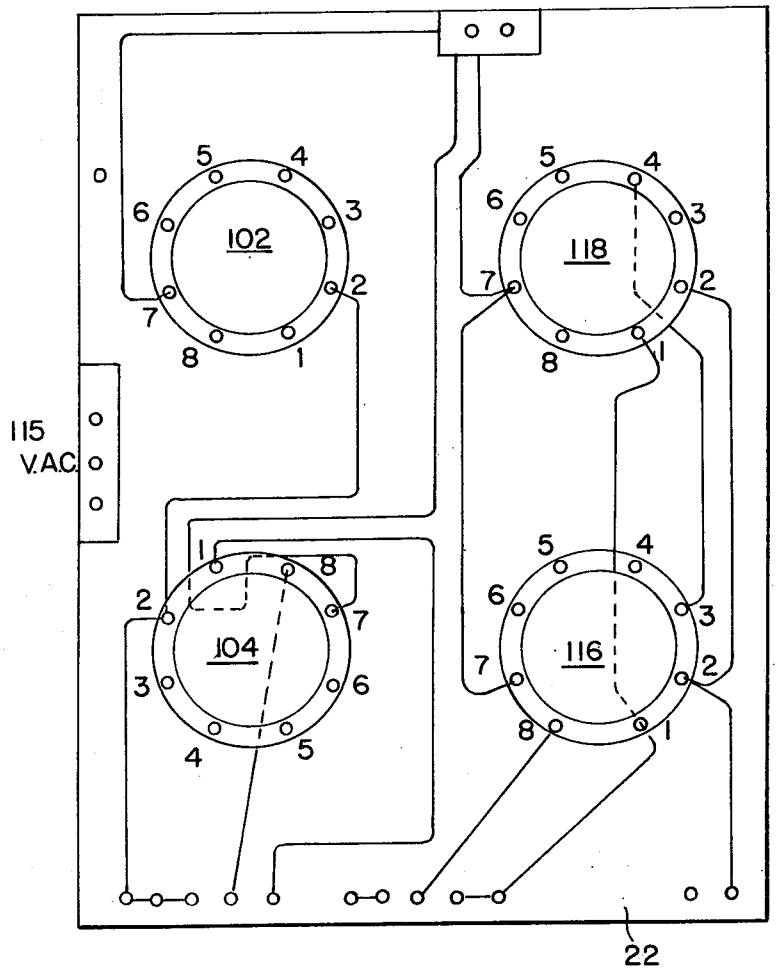

The control circuitry 20 and its complementary circuits 20A and 20B, illustrated in FIGS. 11, 12 and 13, comprise a first relay 102 and a second backup relay 104 arranged in parallel, operation or function signal lamps 106, 108, 110 and 112, a manually operated switch 114 for testing the reliability and operability of the control circuit, a solid state timer 116, a relay type switching device 118 arranged in parallel with the timer 116, and a pair of limit switches 120 and 122 arranged in parallel ahead of the timer 116 and the switching device 118 respectively. The circuit is provided with a conventional power line fuse 124 and connected to a source of electrical energy of 115 volts alternating current, the hot line side indicated by the reference numeral 126 and the ground line side by the numeral 128. A normally closed third limit switch 130, between the solenoid 86 and the ground line 128, opens at 60° and closes at 330° in response to the position of the cam on the shaft 68 in its cycle rotation. The limit switches 120 and 122 close at 30° and open at 330° of the cam rotation. This leaves a gap of 60° within which the blocking member 46 can be projected into ram stopping position.

A combination of gang-type switch 134 comprises the normally closed switching contact elements 136 and 138 and the normally open switching contact element 140 in the circuit portions connected to the relay coils 102-1, 104-1, the signal lamp 106, and the signal lamp 108, respectively. The relays 102 and 104 are provided with switching elements 102-2 and 104-2 respectively connected to the hot-line side of the solenoid 86. the timer 116 is provided with a normally open switching contact 116-1 on the hot-line side of the gang switching element 136, a relay coil 116-2 in the circuit 20B, and a normally closed switching contact 116-3 connected to the hot-line side of the signal lamp 110. The switching relay 118 is provided with the relay coil 118-1 in circuit 20B, in parallel with the timer coil 116-2, and the normally closed switching contact 118-2 arranged in parallel with the normally open timer contact element 116-1.

Referring now more specifically to the circuit portion 20A illustrated in FIG. 12, the relay switching elements 102-3 and 104-3 of the relays 102 and 104 respectively, are connected in series in the emergency off-path conductor or line in the press control circuitry. This emergency off-path line, a part of the press central wiring, is installed and required for completely shutting off the press operation under certain specified conditions, operating automatically and independently of any other press control. The relay switching elements 102-3 and 104-3 are normally closed, but when the coils 102-1 and 104-1 of the relays 102 and 104 are energized, these switching elements will open.

The circuit portion 20B illustrated in FIG. 13 comprises the press holding relay coil 154 in parallel with the relay switching coil 118-1 and the variable coil timer 116-2, by the hot-line conductor 156 and the ground line conductor 158. Although the press holding relay varies from press to press, persons skilled in the art will and can readily identify such relay. The circuit portion 20B illustrated in FIG. 13 is designed for connection to and on either side of the press holding relay coil, so that when the palm buttons 78, 78 are pressed and their switches properly closed, closing the circuit to the press motor 64, the relay coils 154, 118-1 and the timer coil 116-2 in the timer 116 will be energized as shown in the upper portion of circuit 20.

The timer 116 is a solid state manually variable timing device of conventional construction, such as model 1017-B-1 produced by the Industrial Solid State Controls, Inc. of York, Pennsylvania. Such type of timer can be normally preset for timing the relay operation from fractions of a second to several seconds, as required or desired. The relay coil 116-2 of such a timer, as in the circuit 20B of FIG. 13, is preset with respect to the speed of the press ram in its complete cycle, so that the blocking device 16 will move effectively under the press ram bolster plate 88, in the event that a voltage occurs and continues across the circuit 20B, as in this case of a continuous malfunction of the press or a double repetitive stroke.

An air clutch type press has been described above and illustrated in FIGS. 1-4 inclusive. The invention, however, is not limited to utilization only in such press, but can also be used in hydraulic, air cylinder and other similar types of presses, two of which are shown generally and representatively in FIGS. 5–8.

Figure 5:
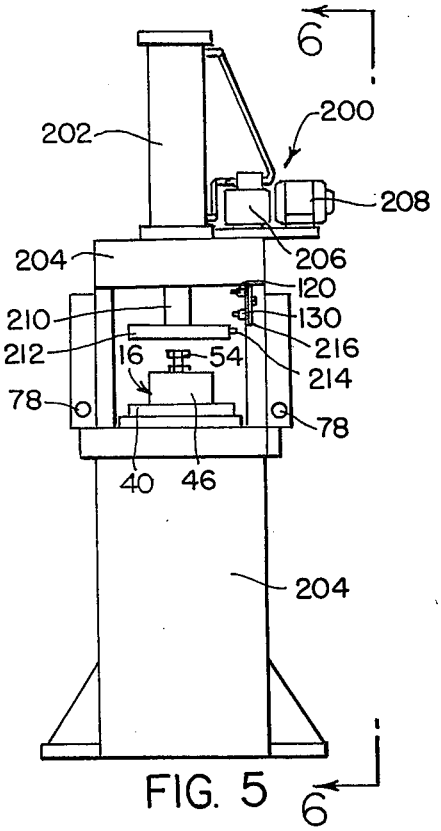
FIGS. 5 and 6 are front and side elevational views respectively of a hydraulic-type press having an embodiment of the invention mounted thereon.
Figure 6:
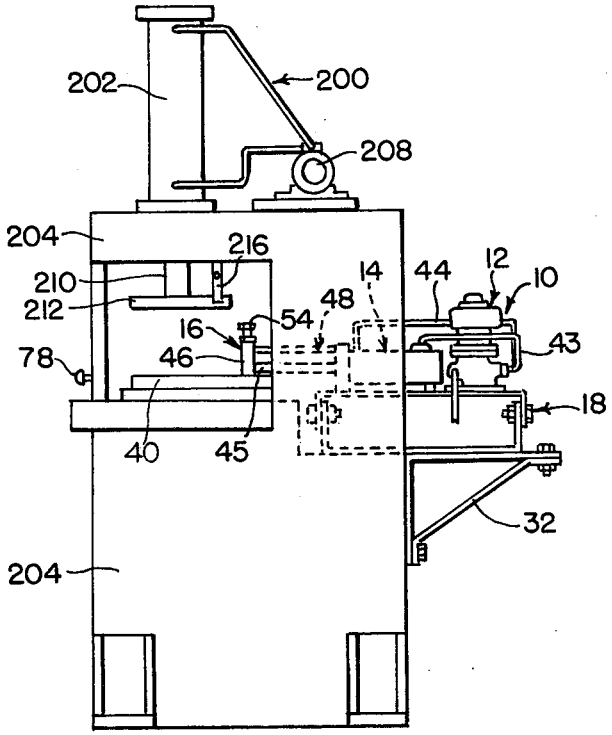

The press illustrated in FIGS. 5 and 6 represents generally a hydraulic type press 200 having a hydraulic cylinder 202 mounted on a press frame 204, the hydraulic fluid for the cylinder being delivered by a pump 206 operated by motor 208 from a suitable source (not shown). The hydraulic cylinder ram 210 is provided at its distal end with a tool-holding bolster plate 212 attached thereto and having a microswitch tripping finger 214 extending laterally for engagement with the microswitches 120, 122 and 130 of circuit 20. The limit switches are mounted upon a vertically adjustable post 216 secured to the framing 204. Such vertical adjustment is designed to accommodate the stroke and speed of the press ram for effective operation of the blocking device 10 which is mounted in the press 200 in the same relationship as that disclosed for the press 30. The press 200 is also provided with palm buttons 78, 78 or similar press actuating means in the press control circuitry similar to that utilized for the press 30.

Figure 7:
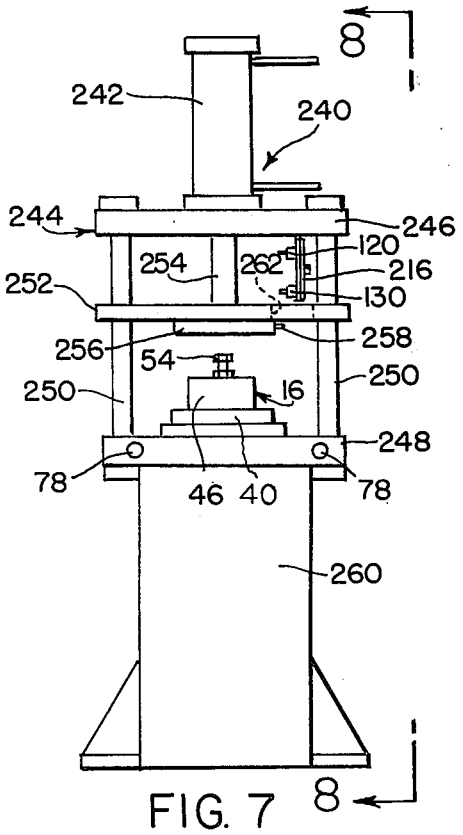
FIGS. 7 and 8 are front and side elevational views respectively of an air cylinder-operated press having an embodiment of the invention mounted thereon.
Figure 8:
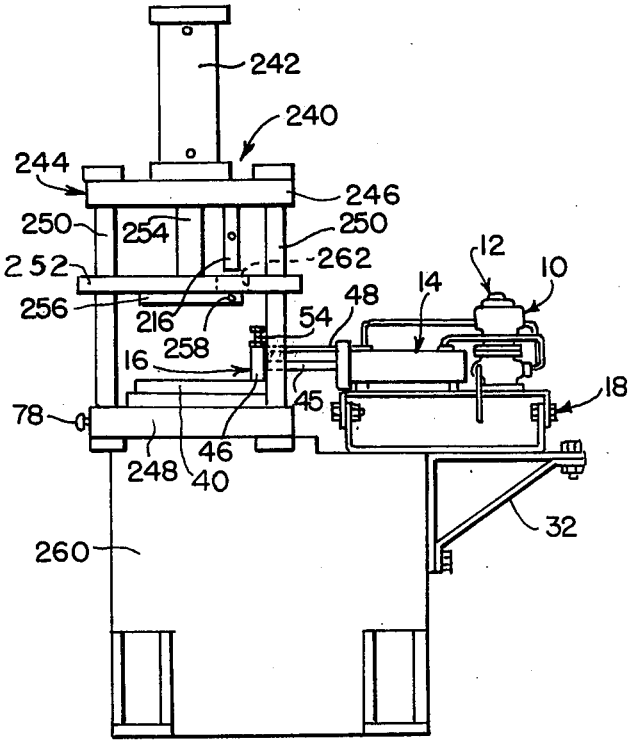

The air cylinder press 240, illustrated FIGS. 7 and 8, generally comprises the air cylinder 242 mounted upon upper framing 244 having an upper plate 246 and a lower plate 248 conjoined by four columns 250 serving as guide posts for the vertically movable ram plate member 252 secured to the distal end of the air cylinder piston rod 254 and supporting the upper tooling bolster plate 256 to which a limit switch trigger 258 is mounted in lateral posture. The upper framing 244 is mounted upon a press stand 260. The piston rod 254 is considered to be substantially the equivalent of the ram of air clutch press 30 and the ram 210 of hydraulic press 200.

The air cylinder 242 is served and actuated by compressed air from a source (not shown) and is controlled by a valve system responsive to press control circuitry similar to that which is utilized with the presses 30 and 200. Such circuitry also embodies the palm buttons 78, 78 or similar manual press actuating means for the cylinder piston and piston rod 254 to move the ram member 252 and the upper bolster plate 256 vertically on the columns 250.

As in the case of the hydraulic press 200, the limit switches 120, 122 and 130 of the circuit 20 are mounted upon a vertically adjustable post 260 secured to the upper framing member 246. A vertically movable plate member 252 is provided with an opening 262 therethrough for admission of the post support member 216 and the limit switches mounted thereon during vertical travel of the plate member. The triggering pin or member 258 mounted on the upper bolster plate 256 is arranged to move in a path whereby the limit switch pins will be engaged upon vertical travel of the ram plate member 252.

The blocking device 10 is mounted on the press 240 in a manner similar to that disclosed for attachment to and operation in the presses 30 and 200.

Figure 9:
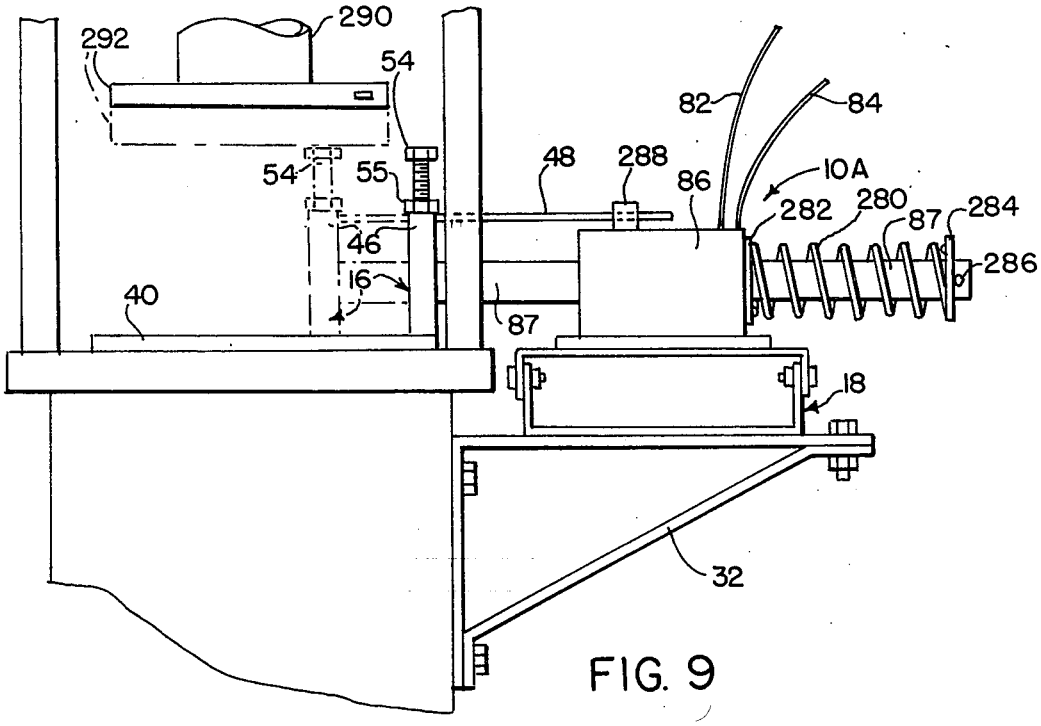
FIGS 9 and 10 are side elevational views of blocking devices actuated by direct acting solenoid units, further exemplary embodiments of the invention.
Figure 10:
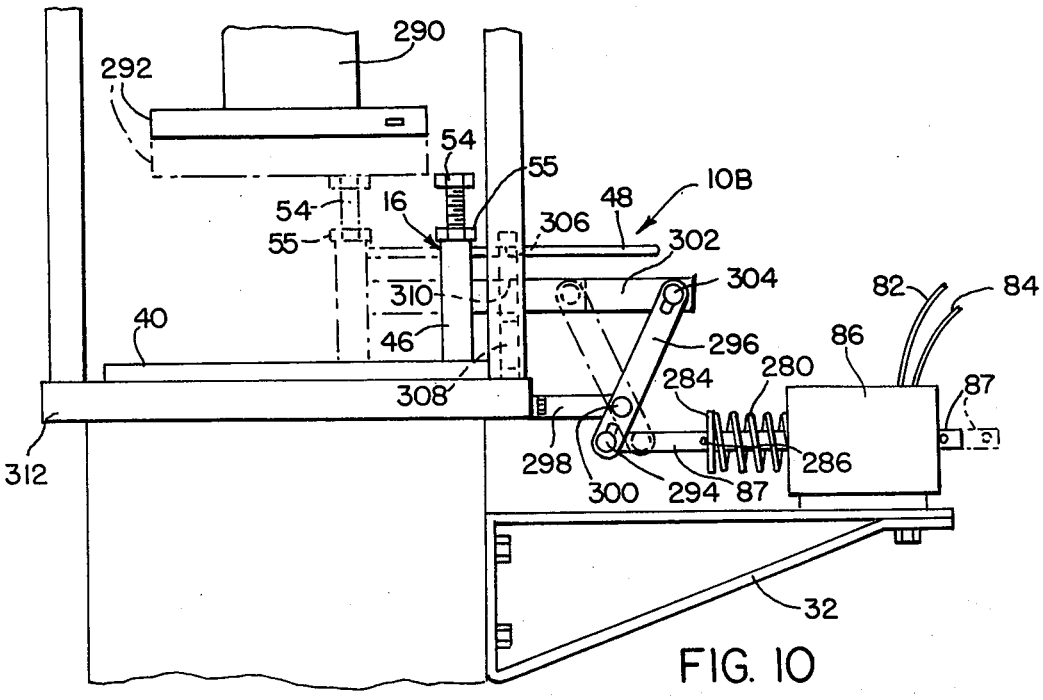

The press ram blocking apparatus 10 as above described can be modified to a more simplified construction by elimination of the solenoid-operated fluid valve 12 and the fluid cylinder 14, the blocking member device 16 being directly affixed or connected to and operated by the solenoid-actuated pin. One such device **10*a* is illustrated in FIG. 9. FIG. 10 illustrates a modification of the direct-acting solenoid illustrated in FIG. 9 by the inclusion of linkage which provides a mechanical advantage for reciprocating movement of the blocking device 16.**

As shown particularly in FIG. 9, the press ram blocking apparatus **10*a* comprises the solenoid 86 having a solenoid pin 87 actuated for movement to the left, as shown in FIG. 9, upon energization of the solenoid coil, the bolster plate blocking device 16, the solenoid pin retracting spring 280 biased against and between the solenoid housing end plate 282 and the spring retaining plate 284 mounted upon the solenoid pin 87, and secured thereon by the pin member 286. The bearing 288 suitably mounted upon the solenoid 86 provides a slide guide for the member 48 secured at its distal end to the blocking member 46 to prevent rotative movement of the blocking member. The press form illustrated in FIG. 9 is merely representative of any of the presses generally described above or which can utilize the invention, such presses having a vertically reciprocatingly movable ram member 290 supporting an upper tool holding bolster plate 292 having a triggering device to engage limit switches 120, 122 and 130 (not shown in this view) according to any of the arrangements heretofore disclosed or which may be more suitable and appropriate depending upon the design and nature of the press in which the press ram blocking apparatus 10***a* is embodied or attached. The apparatus 10*a* is designed for direct forward pushing movement of the blocking device 16.

Alternatively, the solenoid 86 can be arranged for a pulling movement, with or without linkage to effect a mechanical advantage for the blocking member 46 in such movement. As illustrated particularly in FIG. 10, the solenoid 86 is mounted upon the supporting member 32, in fixed or adjustable relationship, the solenoid pin 87, normally in extended posture, being retracted upon energization of the solenoid coil. The forward or distal end of the solenoid pin is connected by a pin 294 to the link 296, which is pivoted upon the support member 298 at the pivot pin 300. The distal end of the link 296 is connected to the lever 302 by the pin 304, the distal end of the lever being fixedly secured to the blocking member 46. As in the blocking devices 10 and 10*a*, the blocking device 10*b* is also provided with a guide member 48, slidably mounted in the bearing 306 of the support device 308. The lever 302 is also supported by the device 308 for sliding movement in the bearing 310. The support device 308 is fixedly mounted upon the framing member 312.

Although the triggering mechanism for limit switches 120, 122 and 130 in presses 200 and 240 is substantially the same, it is to be understood that, in the operation of the circuitry 20, it makes little difference whether the triggering devices 214 and 258 are mounted on bolster plates 212 and 256, or on rams 210 and 254 respectively. For this functional operation, the ram and the bolster plate can and should be considered as one.

It will be readily understood by persons skilled in the art to which the invention pertains that solenoid actuating and control circuitry other than or different in composition from that disclosed herein as circuitry 20, 20A and 20B, according to developing technology, can be used in substitution therefor. Integrated circuit components may be presently available, or designed in the future, to replace some or many of the circuitry components disclosed herein, to effect the same result namely, the actuation and control of the solenoid 86 in the valve 12 or the direct acting solenoid 86 as disclosed in FIGS. 9 and 10 and described hereinabove.

OPERATION

The system apparatus 10 circuitry 20, in combination with the circuit portions 20A and 20B, for the press 30, operate as follows.

For normal press operation in "single stroke" mode, the circuit is and operates as shown in FIG. 11. The timer switching element 116-1 is normally open for the normally preset period of time established by the variable control of the timer coil 116-2. To check the circuitry 20 and apparatus 10 for operability, the toggle or test switch 114 is closed, energizing the relay coils 102-1 and 104-1, closing contact elements 102-2 and 104-2, energizing the valve solenoid 86, actuating the valve 12 to discharge compressed air to the air cylinder 14, driving the piston and its rod 45 forwardly with its attached projecting blocking member 46 into ram blocking position as in FIG. 3.

In the event that either of the limit switches in parallel 120 and 122, which are a back-up one for the other, should close for any reason between 30° and 330° from top center of the crankshaft cam 132, relay switching element 118-2 and gang switch element 136 being in circuit closing position, relay coils 102-1 and 104-1 will be energized, closing relay elements 102-2 and 104-2, energizing the solenoid 86, and driving the blocking member 46 under the ram plate 88 in the manner and by the means described above.

Whenever the relay coils 102-1 and 104-1 are energized, the relay contact elements 102-3 and 104-3, circuit 20A, will open and cut off electric power to the press drive. Since the press is no longer in "drive" condition, no additional energy is imparted to the flywhell 66 and the blocking device 16 will effectively hold the press ram upper bolster plate 88 from the lower die set bolster plate 40.

Normally, the press holding relay coil 154 is energized when the palm buttons 78, 78 are pressed and their switches closed. But should the palm buttons not be pressed substantially uniformly and simultaneously, and held for at least 180° of the ram stroke, the press holding coil 154, the relay switching coil 118-1 and the timer coil 116-2 will deenergize, causing the switching element 118-2 to close. Under these conditions, should the press crankshaft cam 132 rotate more than 30° from top center, limit switches 120 and 122 will close, energizing the relay coils 102-1 and 104-1, closing contacts 102-2 and 104-2, and energizing solenoid 86. The ram blocking member 46 will thereupon be projected forwardly under the ram bolster plate 88, unless the palm buttons 78, 78 are released betweeen 60° and 180° of crankshaft rotation. Should they be so released, the limit switch 130 will open and the ram blocking member 46 will not be projected forwardly. Moreover, the press drive control will be shut off by virtue of contacts 102-3 and 104-3 opening, breaking the emergency off-path circuit 20A (FIG. 12). Normal press braking action will then occur.

Limit switches 120 and 122 are preset on the machine frame 62 in association with the crankshaft cam 132 so that they will close upon rotation of the cam starting at 30° from top center (when the press ram is at the top of its stroke) and remain closed until the cam has rotated 330°, or again 30° from top center, leaving the limit switches open for a rotation interval of 60°.

So long as the relay coil 118-1 is energized, its switching element 118-2 remains open. In the event that the relay coil 118-1 is not energized upon 30° of crankshaft rotation, as for instance if no electric current is passing to the relay coil 54, then switching element 118-2 will remain closed and relay coils 102-1 and 104-1 will be energized through limit switches 120 and 122, and closed contacts 118-2 and 136. The press control will not be powered and the press will not operate, because contacts 102-3 and 104-3 will open.

The normally closed relay switching element 118-2 will open under another condition. For normal operation of the press 30, the operator must press both palm buttons 78, 78 simultaneously, and must hold these palm buttons in switching contact for at least 180° of crankshaft operation. The length of time varies from press to press depending upon the speed of rotation of the crankshaft. In the event that one or the other, or both palm buttons are released prior to such 180° of crankshaft rotation, the press holding coil 154 will not be energized and the press clutch will declutch and normal conventional press braking action occur. However, the press will shut off through operation of limit switches 120 and 122, normally closed contacts 118-2, normally closed contacts 136 and energized coils 102-1 and 104-1 which open the emergency off-path circuit 20A at contacts 102-3 and 104-3.

The limit switches 120 and 122, though shown to one side of the framework 62 for greater visibility, are more usually located within the framework, substantially central of the shaft and adjacent the cam on the press ram crank. Of course, cam location will vary, in accordance with press style and design.

Before normal press operation can be restarted, the following procedure is required. The gang switch 134 is operated to close the switching element 140, energizing the signal lamp 108, and opening the switching elements 136 and 138. The press start button is then depressed and its switch closed. The gang switch 134 is designed alternately for use as a continuous operation switch or as an inching switch. The inching switch portion is closed and the press ram inched downwardly and then upwardly to the top of its stroke, a full 360° rotation of the flywheel. The gang switch 134 is then reversed, opening the switching element 140 and closing the elements 136 and 138, the signal lamp 108 being deenergized. The selector on the main press control panel is then set for "single stroke" operation, and normal single stroke operation can then be resumed.

In setting up the blocking device 16, the press ram 41 is first retracted to full top position, and the blocking device 16 when extended is then adjusted in height to a dimension slightly or somewhat below the lower face of the elevated ram bolster plate 88. The lock nut 55 is then tightened upon the blocking screw 54 to maintain the adjusted blocking height. Whenever the ram shut height is adjusted, as for instance when a die set or tooling is changed, the blocking screw 54 should be adjusted as above described. The adjusted blocking height of the device 15 is related to the shut height of the ram and to the ram stroke rate. The desired gap above the top surface of the blocking device 16 will vary in view of the shut height, the stroke speed of the ram, the speed of the piston rod 45 and the distance to be travelled by the blocking member 46. Persons skilled in the art to which the invention pertains are qualified to determine the preferred or required gap between the blocking screw 54 and the ram bolster plate 88.

The solid state timer is the "back-up" of all of the electrical components of the press. Setting up the timer is relatively simple but of vital importance. The procedure and sequence include closing the switching element 140 by manually operating the gang switch 134, energizing the signal lamp 108. The test switch 114 is opened, shutting off current to the signal lamp 106. The main press control switch is set for "single stroke" operation. The press control switch is closed energizing the drive motor 64. The timer relay coil 116-2 is adjusted for its minimal time delay interval. The palm buttons 78, 78 are then depressed and their switches closed, causing the signal lamp 110 to flash as the press cycles. The variable control of the timer relay coil 116-2 is then slowly increased until the signal lamp 110 just stops flashing at each cycle, the lamp being and remaining on for each cycle of crankshaft rotation and ram stoke. After the timer is adjusted, the time interval should be locked against possible inadvertent variation. The gang switch element 140 is then returned to normal open position and the signal lamp 108 deenergized. The foregoing procedure for adjustment of the solid state timer variable control 116-2 should be repeated periodically in order to double-check and maintain the effective time interval for operation of the solenoid-operated blocking device 16.

As illustrated particularly in FIGS. 9 and 10, the direct acting solenoid attached blocking member 46, FIG. 9, will be pushed forward by the solenoid pin 87 upon the solenoid 86 being energized in circuit 20 as above described. When the solenoid coil is deenergized, the retracting spring 280 will pull the solenoid pin 87 rearwardly bringing the blocking member 46 with it and beyond the path of travel of the ram mounted bolster plate 292. In the FIG. 10 illustration of the direct acting solenoid, the linkage 296 and lever 302 connected to the solenoid pin 87 moves the blocking device 16 by mechanical advantage a distance greater than that moved by the solenoid pin when the solenoid 86 is energized and deenergized. Retraction of the blocking member 46 is effected, upon deenergization of the solenoid coil, by the spring 280 pushing the solenoid pin 87 forwardly to its normal position. The direct acting solenoid 86 is the actuating means for the blocking device 16 in each of the exemplary embodiments illustrated in the views of FIGS. 9 and 10.

The use of multiple relay coil devices and limit switches for press blocking operation are highly desirable features. Such back-up devices enable the press blocking system of this invention to assure a greater measure of safety for press operating personnel and the equipment as well.

Although particular embodiments of the invention have been disclosed herein for purposes of explanation, further modificatons or variations thereof, after study of this specification, will or may become apparent to those skilled in the art to which the invention pertains. Reference should be had to the appended claims in determining the scope of the invention.

We claim:

1. In a press ram blocking and control system for a press having a frame supporting a movable ram-affixed upper tool holding bolster plate and a lower die plate, means for reciprocatingly moving said ram-affixed upper bolster plate relative to said lower die plate, and press control circuitry to actuate and control said means to reciprocatingly move a frame supported ram, the improvement comprising in combination a solenoid operated fluid valve, a fluid cylinder communicating with said valve and having a reciprocatingly movable piston and piston rod actuated by operation of said solenoid and valve, means securing said cylinder and valve to said press frame, a reciprocatingly movable blocking member for said upper bolster plate affixed to the distal end portion of said piston rod projecting from said fluid cylinder, solenoid actuating and control means electrically connected to said valve operating solenoid and mounted on said press frame for actuation by said means for moving said upper bolster plate, and solenoid-connected and actuating circuitry connected and responsive to said solenoid actuating and control means upon a malfunction in normal press operation, whereby said blocking member is insertable between said movable upper bolster plate and said lower die plate in response to solenoid operated valve actuation of said fluid cylinder piston and piston rod upon the occurrence of a malfunction in normal press operation.

2. The system defined in claim 1, wherein
said solenoid-connected and -actuating means includes means and circuitry for testing said solenoid actuating and control means to detect a means or circuitry failure.

3. The system defined in claim 1, wherein
said means for reciprocatingly moving said bolster plate comprises
a motor driven crankshaft having a cam thereon,
and said ram reciprocatingly movable in said frame, said upper bolster plate being affixed to the distal end of said ram,
said solenoid actuating and control means being mounted on said frame for actuation by and upon predetermined rotation of said cam.

4. The system defined in claim 3, wherein
said solenoid actuating and control means comprises limit switches forming a part of said solenoid-connected and -actuating circuitry and mounted on said frame in the rotating travel path of said cam.

5. The system defined in claim 1, wherein
said means for reciprocatingly moving said bolster plate comprises
hydraulic power means,
said ram being connected to and reciprocatingly movable in said frame by said hydraulic power means.

6. The system defined in claim 5, wherein
said solenoid actuating and control means comprises limit switches forming a portion of said solenoid-connected and -actuating circuitry,
means secured to said frame for mounting said limit switches adjacent the travel path of said ram-affixed bolster plate,
and triggering means to actuate said limit switches in the reciprocating movement of said ram-affixed bolster plate.

7. The system defined in claim 6, wherein
said means for mounting said limit switches to said press frame comprises an adjustable post upon which said limit switches are secured in operative posture relative to said triggering means.

8. The system defined in claim 1, wherein
said means for reciprocatingly moving said bolster plate comprises
air cylinder power means,
said ram being connected to and reciprocatingly movable in said frame by said air cylinder power means.

9. The system defined in claim 8 wherein
said solenoid actuating and control means comprises limit switches forming a portion of said solenoid-connected and -actuating circuitry,
means secured to said frame for mounting said limit switches adjacent the travel path of said ram-affixed bolster plate,
and triggering means to actuate said limit switches in the reciprocating movement of said ram-affixed bolster plate.

10. The system defined in claim 9, wherein
said means for mounting said limit switches to said press frame comprises an adjustable post upon which said limit switches are secured in operative posture relative to said triggering means.

11. The system defined in claim 1, wherein
said blocking member is aligned with said lower die plate so as to move in a plane directly above said lower die plate and come to rest thereon.

12. The system defined in claim 1, wherein
said blocking member is adjustable as to its height by means mounted on the body of said blocking member and extendible upwardly therefrom.

13. The system defined in claim 1, wherein
said blocking member is adjustable as to its height by screw means threadedly mounted in said blocking member and extending upwardly from a surface thereof.

14. The system defined in claim 1, wherein
said blocking member is provided with means preventing rotation of said blocking member in its reciprocating movement.

15. The system defined in claim 14, wherein
said rotation-preventing means comprises
a guide rod affixed to said blocking member and slidable in a bearing on said fluid cylinder.

16. The system defined in claim 14, wherein
said rotation-preventing means comprises
a guide rod affixed to said blocking member and slidable in a bearing on said frame.

17. The system defined in claim 1, wherein
said solenoid-connected and -actuating circuitry is connected to and served by a power source for said press circuitry.

18. The system defined in claim 17, wherein
solenoid-actuating portions of said solenoid-connected and -actuating circuitry are connected to and in said press control circuitry.

19. In a press blocking and control system for a press having
a frame supporting a movable upper ram-affixed tool holding bolster plate and a lower die plate,
means for reciprocatingly moving said ram-affixed upper bolster plate relative to said lower die plate,
and press control circuitry to actuate and control said means to reciprocatingly move a frame supported ram,
the improvement comprising in combination
a solenoid comprising a housing, a coil and a pin axially movable in said coil,
said solenoid pin having at least one end portion thereof projecting beyond an end of said housing,
means securing said solenoid on and to said press frame, a reciprocatingly movable blocking member for said upper bolster plate connected to said projecting end portion of said solenoid pin,
solenoid actuating and control means electrically connected to said solenoid coil and mounted on said press frame for actuation by triggering means on said ram-affixed bolster plate,
and solenoid-connected and -actuating circuitry connected and responsive to said solenoid actuating and control means upon a malfunction in normal press operation,
whereby said blocking member is insertable between said movable upper bolster plate and said lower die plate in response to solenoid coil actuation of said solenoid pin upon the occurrence of a malfunction in normal press operation.

20. The system defined in claim 19, wherein
said means for reciprocatingly moving said bolster plate comprises
a motor driven crankshaft having a cam thereon,
and said ram reciprocatingly movable in said frame,
said upper bolster plate being affixed to the distal end of said ram, said solenoid actuating and control means being mounted on said frame for actuation by and upon predetermined rotation of said cam.

21. The system defined in claim 20, wherein said solenoid actuating and control means comprises limit switches forming a part of said solenoid-connected and -actuating circuitry and mounted on said frame in the rotating travel path of said cam.

22. The system defined in claim 19, wherein said means for reciprocatingly moving said bolster plate comprises
hydraulic power means, said ram being connected to and reciprocatingly movable in said frame by said hydraulic power means.

23. The system defined in claim 22, wherein said solenoid actuating and control means comprises
limit switches forming a portion of said solenoid-connected and -actuating circuitry,
means secured to said frame for mounting said limit switches adjacent the travel path of said ram-affixed bolster plate,
and triggering means to actuate said limit switches in the reciprocating movement of said ram-affixed bolster plate.

24. The system defined in claim 23, wherein said means for mounting said limit switches to said press frame comprises an adjustable post upon which said limit switches are secured in operative posture relative to said triggering means.

25. The system defined in claim 19, wherein said means for reciprocatingly moving said bolster plate comprises
air cylinder power means,
said ram being connected to and reciprocatingly movable in said frame by said air cylinder power means.

26. The system defined in claim 25, wherein said solenoid actuating and control means comprises
limit switches forming a portion of said solenoid-connected and -actuating circuitry,
means secured to said frame for mounting said limit switches adjacent the travel path of said ram-affixed bolster plate,
and triggering means to actuate said limit switches in the reciprocating movement of said ram-affixed bolster plate.

27. The system defined in claim 26, wherein said means for mounting said limit switches to said press frame comprises an adjustable post upon which said limit switches are secured in operative posture relative to said triggering means.

28. The system defined in claim 19, wherein said blocking member is aligned with said lower die plate so as to move in a plane directly above said lower die plate and come to rest thereon.

29. The system defined in claim 19, wherein said blocking member is adjustable as to its height by means mounted on the body of said blocking member and extendible upwardly therefrom.

30. The system defined in claim 19, wherein said blocking member is adjustable as to its height by screw means threadedly mounted in said blocking member and extending upwardly from a surface thereof.

31. The system defined in claim 19, wherein said blocking member is provided with means preventing rotation of said blocking member in its reciprocating movement.

32. The system defined in claim 31, wherein said rotation-preventing means comprises
a guide rod affixed to said blocking member and slidable
in a bearing on said fluid cylinder.

33. The system defined in claim 31, wherein said rotation-preventing means comprises
a guide rod affixed to said blocking member and slidable in a bearing on said frame.

34. The system defined in claim 19, wherein said solenoid-connected and -actuating circuitry is connected to and served by a power source for said press control circuitry.

35. The system defined in claim 34, wherein solenoid-actuating portions of said solenoid-connected and -actuating circuitry are connected to and in said press control circuitry.

36. The system defined in claim 19, wherein said blocking member is directly affixed to said solenoid pin projecting end portion.

37. The system defined in claim 19, wherein said blocking member is lever-connected to said solenoid pin projecting end portion for mechanical advantage movement of said blocking member relative to solenoid pin movement.

38. The system defined in claim 19, wherein said solenoid-connected and -actuating means includes means and circuitry for testing said solenoid actuating and control means to detect a means or circuitry failure.

* * * * *